US006375443B1

(12) United States Patent
Yoshimura

(10) Patent No.: US 6,375,443 B1
(45) Date of Patent: Apr. 23, 2002

(54) SCREW ROTOR TYPE WET VACUUM PUMP

(75) Inventor: Masashi Yoshimura, Yamaguchi (JP)

(73) Assignee: Taiko Kikai Industries Co., Ltd. (JP)

( * ) Notice: Subject to any disclaimer, the term of this patent is extended or adjusted under 35 U.S.C. 154(b) by 0 days.

(21) Appl. No.: 09/647,254

(22) PCT Filed: Apr. 30, 1998

(86) PCT No.: PCT/JP98/01983

§ 371 Date: Sep. 22, 2000

§ 102(e) Date: Sep. 22, 2000

(87) PCT Pub. No.: WO99/49219

PCT Pub. Date: Sep. 30, 1999

(30) Foreign Application Priority Data

Mar. 24, 1998 (JP) ..... 10-075319

(51) Int. Cl.[7] ..... F04C 18/16; F04C 29/02

(52) U.S. Cl. ..... 418/84; 418/87; 418/97; 418/100; 418/201.1; 418/201.2

(58) Field of Search ..... 418/84, 87, 97, 418/100, 201.1, 201.2

(56) References Cited

U.S. PATENT DOCUMENTS

| | | | | |
|---|---|---|---|---|
| 2,705,922 A | | 4/1955 | Rathman | 418/201.1 |
| 4,758,138 A | * | 7/1988 | Timuska | 418/100 |
| 4,995,797 A | * | 2/1991 | Tsuboi | 418/84 |
| 5,667,370 A | | 9/1997 | Im | 418/201.1 |
| 5,697,772 A | | 12/1997 | Kawamura et al. | 418/201.3 |
| 5,800,151 A | | 9/1998 | Kawamura et al. | 418/201.3 |

FOREIGN PATENT DOCUMENTS

| | | | | |
|---|---|---|---|---|
| EP | 0389036 | * | 9/1990 | 418/97 |
| JP | 61-171891 | | 10/1986 | |
| JP | 1-80688 | | 5/1989 | |
| JP | 2-17716 | | 4/1990 | |
| JP | 2-135689 | | 11/1990 | |
| JP | 2-275089 | | 11/1990 | |
| JP | 2-283890 | | 11/1990 | |
| JP | 4-43884 | | 2/1992 | |
| JP | 4-183990 | | 6/1992 | |
| JP | 8-74765 | | 3/1996 | |
| JP | 8-277790 | | 10/1996 | |
| JP | 9-264276 | | 10/1997 | |

* cited by examiner

*Primary Examiner*—John J. Vrablik
(74) *Attorney, Agent, or Firm*—Baker & Daniels

(57) ABSTRACT

A feed pipe 26 for a sealing water is connected to a housing of the pump to communicate with an enclosed chamber which is defined between a position in which a helical seal line of screw rotors 17 isolates the enclosed chamber from a suction port 15 of the pump and another position in which the enclosed chamber begins to open to a discharge port 24. Alternatively, a feed pipe for the sealing water is connected to the suction port 15 of the vacuum pump, and the feed pipe 26 is provided with a valve V which opens when the suction pressure of the sealing water becomes lower than −380 mmHg.

2 Claims, 6 Drawing Sheets

SCREW ROTOR TYPE WET VACUUM PUMP

FIELD OF THE INVENTION

The present invention relates to a positive displacement vacuum pump, more particularly to a screw rotor type wet vacuum pump which can draw in by itself a sealing water supplied from a suction side. The wet vacuum pump can prevent direct contact of a pump casing with rotors due to thermal expansion caused by heat generated during an adiabatic compression step of the pump. The adiabatic compression step reduces an energy for driving the rotors.

BACKGROUND OF THE INVENTION

A screw rotor type vacuum pump has been used for many applications in various fields such as gas vacuuming, gas suction, cleaning, and pneumatic conveying of powder, particles, and viscous materials.

FIG. 8 is a general illustration showing a sludge stripping unit which is an application example of the vacuum pump. In the sludge stripping unit, a sludge collection hopper tank 1 receives an end of a sludge suction pipe 2. The suction pipe 2 has a flange 3 positioned outside the hopper tank 1. The flange 3 is connected to a hose 4 for drawing in the sludge. The hopper tank 1 has a top wall provided with a conduit 7 communicating with an inner pipe 6 of a separator 5. The separator 5 has an air duct 8 positioned at an upper portion thereof. The air duct 8 is connected to a suction inlet of a vacuum pump A. A discharge side portion of the vacuum pump A is connected to an exhaust pipe 10 via a silencer 9.

Operating the vacuum pump A reduces the inner pressure of the separator 5 and the hopper tank 1. A worker puts the leading end of the sludge suction pipe 2 on the sludge, so that an air is drawn in together with the sludge through the sludge suction pipe 2 into the hopper tank 1. The sludge hits a top wall of the hopper tank 1 to be splashed backward, which allows a primary separation of the sludge and the drawn-in air.

The sludge having a comparatively large specific gravity falls to accumulate on a bottom wall of the hopper tank 1, while the air passes through the conduit 7 to flow downward in the inner pipe 6 of the separator 5. Then, the air passes through a liquid filled in the separator 5, allowing a secondary separation of the sludge and the air.

That is, the sludge included in the air is captured by the liquid, and only the air flows upward through a space outside of the inner pipe 6 into the air duct 8.

The air that has flown into the air duct 8 is drawn into the vacuum pump A, and then the air is discharged from a discharge port of the vacuum pump A into the silencer 9. Finally, the air is discharged in the atmosphere from the silencer 9 through the exhaust pipe 10.

When the sludge is stripped by means of the vacuum pump as described above, small amounts of entrained matters such as dust and pebbles still remain in the air even after the secondary separation. There is a fear of a damage of a sealing portion of the vacuum pump which draws in the air.

The screw rotor type vacuum pump A has a construction as illustrated in a longitudinal sectional view of FIG. 6. The pump has a housing 11 consisting of a main housing 12 having an inner cylinder 12*a*, a gear housing 13 closing a right end portion of the inner cylinder 12*a*, and a side cap 14 closing a left end potion of the inner cylinder 12*a*.

The main housing 12 is provided with a suction port 15 communicating with the inner cylinder 12*a*, and the side cap 14 is provided with a discharge port 16 communicating with the inner cylinder 12*a*.

The housing 11 accommodates a pair of screw rotors 17 (one of which is illustrated in FIG. 6) each consisting of a screw portion 17*a* and a shaft portion 17*b* provided at each end of the screw portion 17*a*. The screw portions 17*a* are of a Quimby type. The screw portion 17*a* has a normal section envelop consisting of a circular arc and a quasi-Alchimedean spiral curve.

The shaft portion 17*b* is rotatively supported by a fixed bearing 18 provided in the side cap 14 and by an expansion side bearing 19 provided in the main housing 12.

By sealing lines provided by the engagement of the pair of the screw portions 17*a* of the screw rotors 17 and the inner cylinder 12*a* of the main housing 12, there is defined an enclosed chamber 20.

By means of a pair of gears 21 each secured on each shaft portion 17*b*, the pair of screw rotors 17 rotate in opposite directions at the same speed as each other. Thereby, a fluid is drawn in from the suction port 15 of the main housing 12 into the enclosed chamber 20, and then the fluid is discharged from the discharge port 16 when the enclosed chamber 20 has moved to communicate with the discharge port 16.

For reducing the driving force of the vacuum pump, there is provided a discharge outlet 24 (see FIG. 2) for adjusting the open degree of the discharge port 16 to compress the drawn-in fluid at a compression rate of about 1/1.6 before discharging it.

FIG. 7 is a graph showing a relationship between a pressure (P) and a volume (V). The pressure is indicated by a vertical coordinate, and the volume is indicated by a horizontal coordinate. A one-step Roots vacuum pump and a screw rotor type vacuum pump with no adiabatic compression step each have an energy shown by a square area defined by points A, B, C, and D. Meanwhile, a screw rotor type vacuum pump with an adiabatic compression step has an energy shown by a semi-square area defined by points A, B, E, and D, which saves an energy shown by a diagonally shaded area of $\Delta E$.

The vacuum pump with an adiabatic compression step has to be a wet type pump to prevent direct contact of the screw rotor 17 and the housing 11 due to thermal expansion by heat generated during the adiabatic compression. The wet type pump generally draws in a sealing water by a vacuum generated in a suction port of the pump.

However, the water drawn in from a suction port 15 flows along a screw channel in an axial direction of the pump, and the water under pressure hits a discharge side shaft sealing portion 22 (see FIG. 6) like a water jet.

As, illustrated in FIG. 9, the shaft sealing portion 22 receives an increased force by the water pressure exerted thereon. The increased force produces no adverse effect for a service life of the shaft sealing portion 22, when the water is clean and includes no entrained matter such as dust or pebbles.

Meanwhile, when the water includes an entrained matter such as dust or pebbles, the shaft sealing portion 22 will have a reduced service life. If the shaft sealing portion 22 suffers a damage, the sealing water leaks into the fixed bearing 18 adjacent to the shaft sealing portion 22, which causes a breakage of lubrication of a grease fed in the fixed bearing 18. In addition, the deposition of the entrained matter such as dust or pebbles on the fixed bearing 18 tends to cause a damage of the fixed bearing 18.

To prevent the damage of the fixed bearing 18, a method is proposed, in which a slinger (or flinger) 23 is mounted on the shaft portion 17*b* as illustrated in FIG. 10. The slinger 23 rotates together with the screw rotor 17 to throw away a water leaked from the shaft sealing portion 22 to discharge it outside of the housing 11. Nevertheless, the method has the disadvantages that the discharged water makes an area surrounding the pump dirty and that a shortage of the sealing water occurs when a circulation system is applied for the water to save it.

In the present invention, when the suction pressure of a fluid is between a normal atmospheric pressure and −380 Hg, the fluid pressure of the discharge side becomes higher than the normal atmospheric pressure because, the fluid is compressed at a compression rate of about ½ in the discharge side. Meanwhile, when the suction pressure of the fluid is lower than −380 mmHg, the fluid pressure of the discharge side becomes lower than the normal atmospheric pressure. This lower discharge side pressure provides no leak of the sealing water from the shaft sealing portion 22 but acts to draw in the shaft sealing portion 22. Moreover, the inventors of the present invention have found that no direct contact of the screw rotor 17 and the housing 11 occurs even without a sealing water when the suction pressure of the fluid is higher than −380 mmHg. Through the use of these effects, the present invention eliminates the disadvantages described in the background of the invention.

SUMMARY OF THE INVENTION

To eliminate the disadvantages, a screw rotor type wet vacuum pump according to the invention includes a housing having an inner cylinder accommodating a pair of screw rotors engaging with each other. The screw rotors are of a Quimby type. Each of the rotors has a screw profile having a circular arc and aquasi-Archimedean spiral curve. A discharge port is opened when the rotation of the screw rotors 17 reduces the volume of an enclosed chamber at a compression rate of about 1/1.6. The enclosed chamber is defined by the rotors and the housing to receive a fluid drawn in from a suction port of the housing.

A feed pipe for a sealing water is connected to the housing to communicate with the enclosed chamber which is defined between a position in which a helical seal line of the screw rotors isolates the enclosed chamber from the suction side 6f the pump and another position in which the enclosed chamber begins to open to the discharge port.

Alternatively, a feed pipe for the sealing water is connected to the suction port of the vacuum pump, and the feed pipe is provided with a valve which opens when the suction pressure for the sealing water becomes lower than −380 mmHg.

EMBODIMENT OF THE INVENTION

Figure 1:
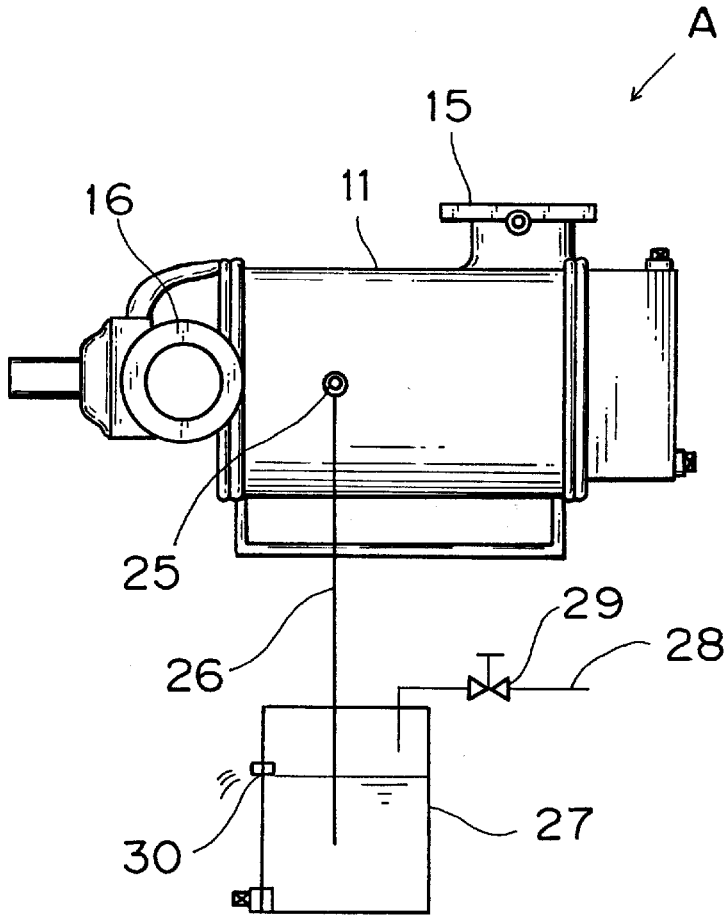
FIG. 1 is a general front view of a screw rotor type wet vacuum pump for explaining a first embodiment of the present invention.

Referring to the drawings, embodiments of the present invention will be discussed hereinafter.

Figure 2:
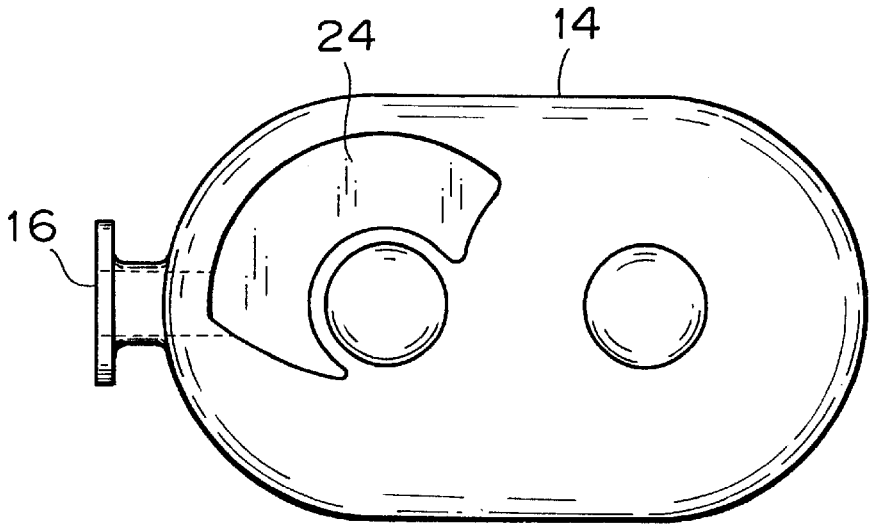
FIG. 2 is a front view showing a side housing with a discharge port of the pump.
Figure 3:
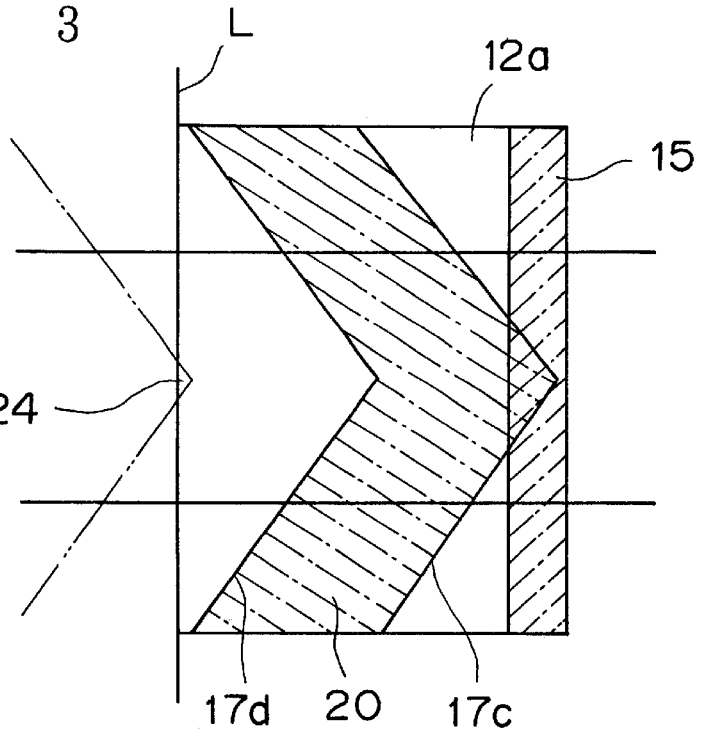
FIG. 3 is an illustration showing a relationship between an enclosed chamber and the discharge port.
Figure 4:
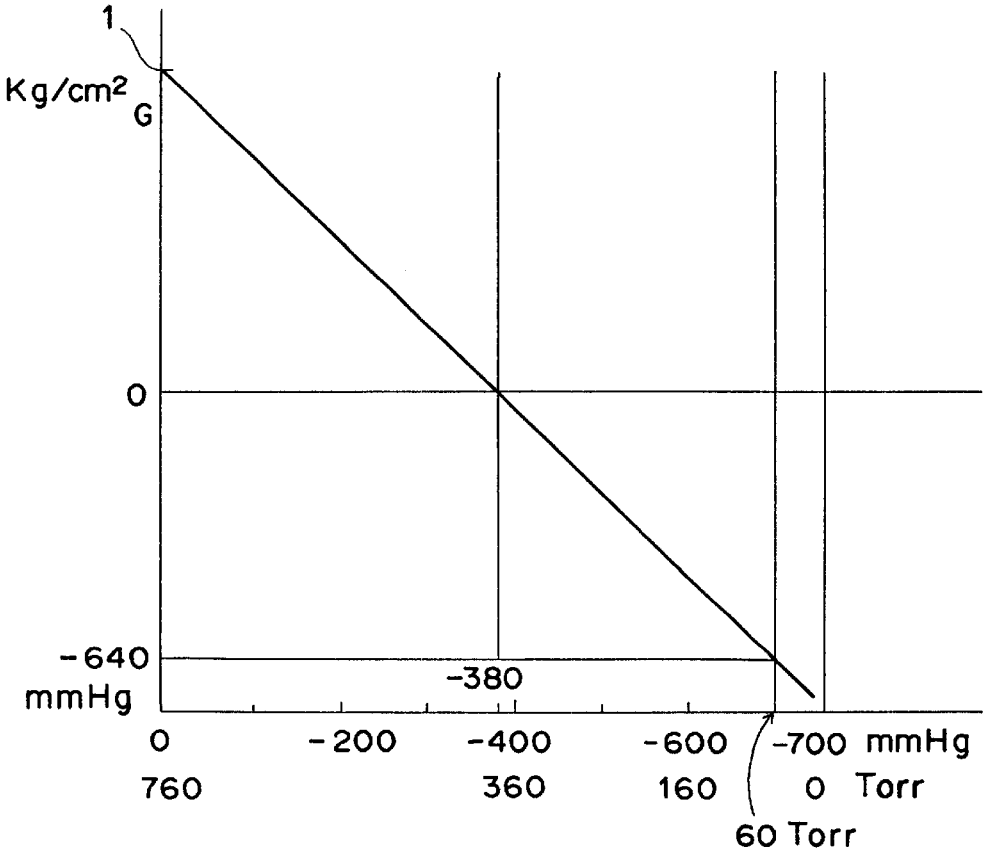
FIG. 4 is a graph showing a relationship between a suction pressure and a pressure just before releasing regarding to the pump.
Figure 5:
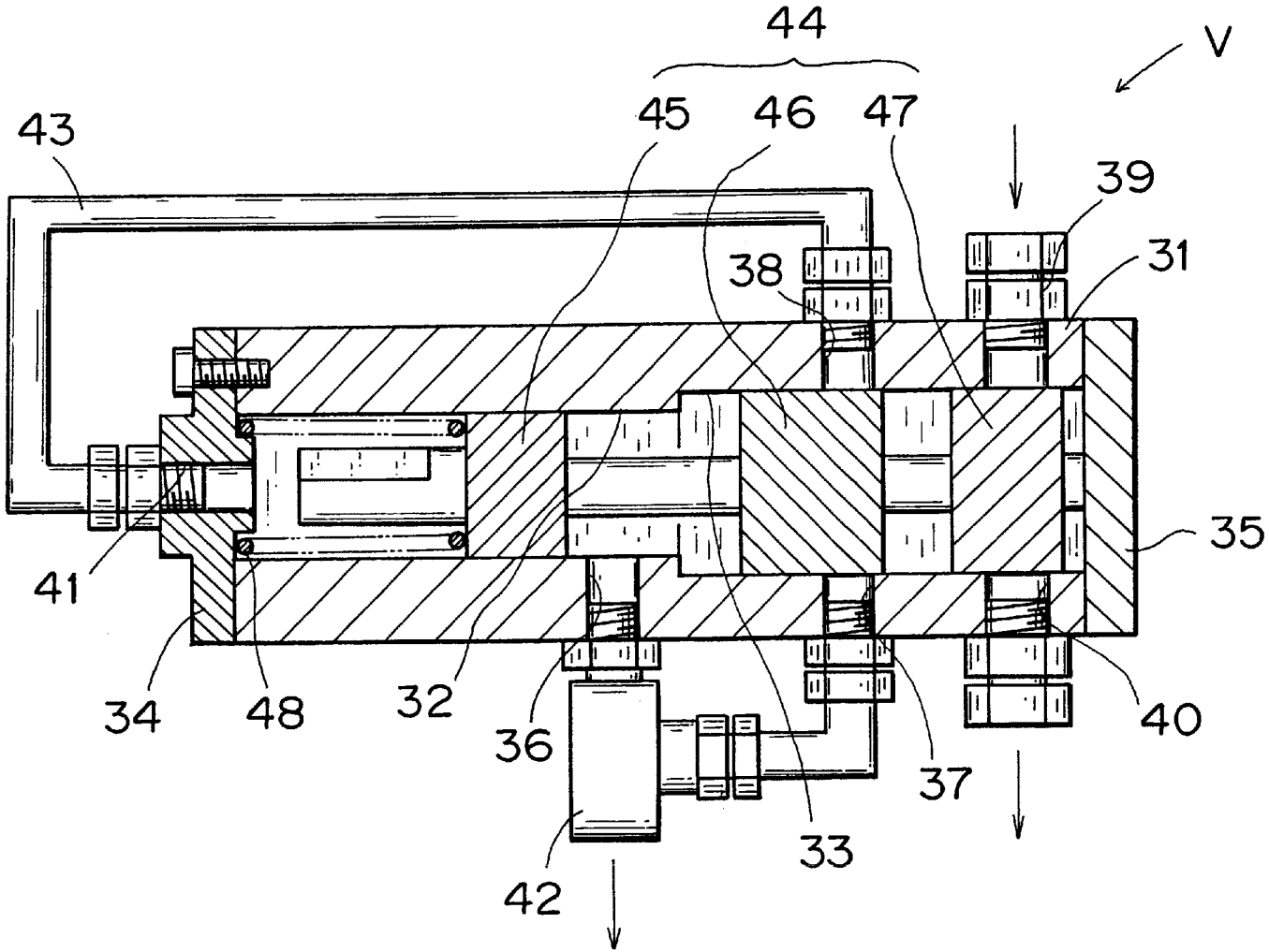
FIG. 5 is a longitudinal sectional view showing an example of a valve included in a second embodiment of the present invention.
Figure 6:
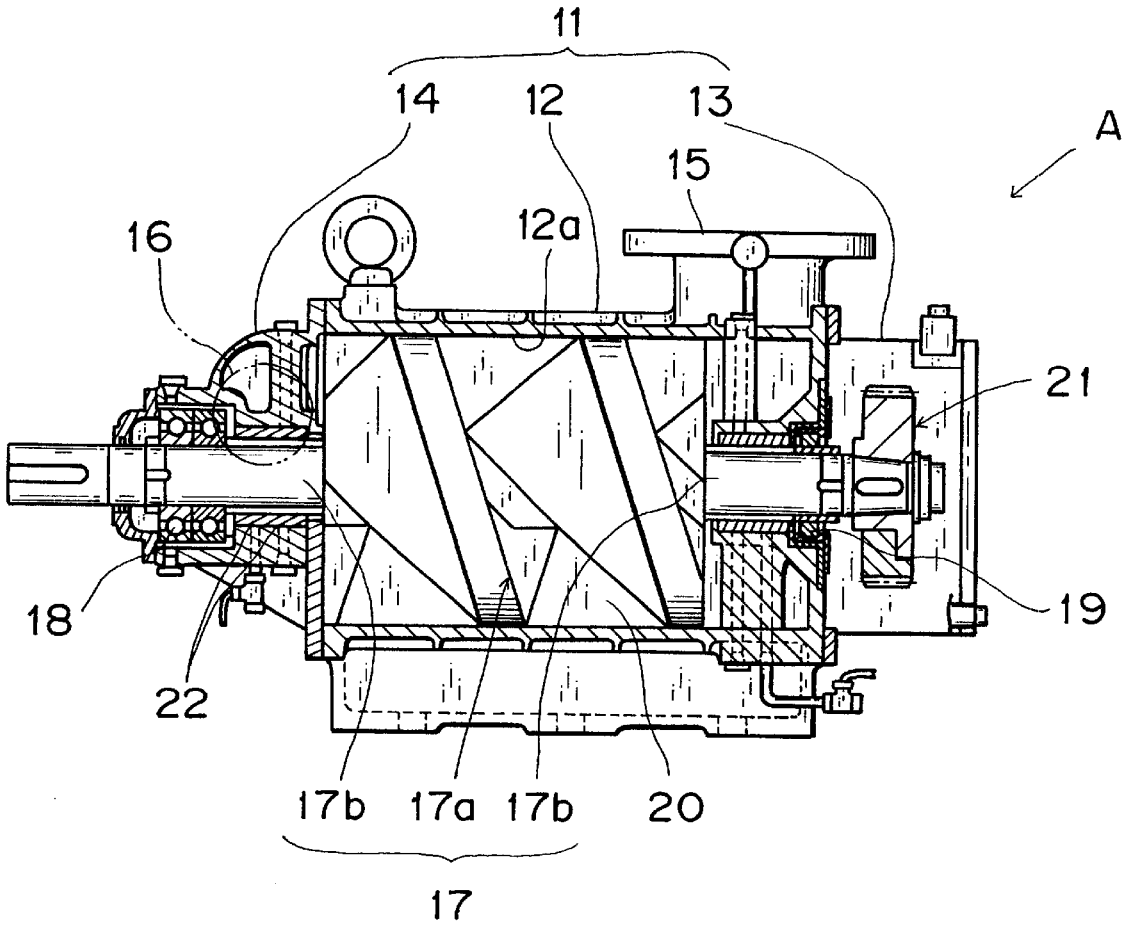
FIG. 6 is a longitudinal sectional view showing the vacuum pump.
Figure 7:
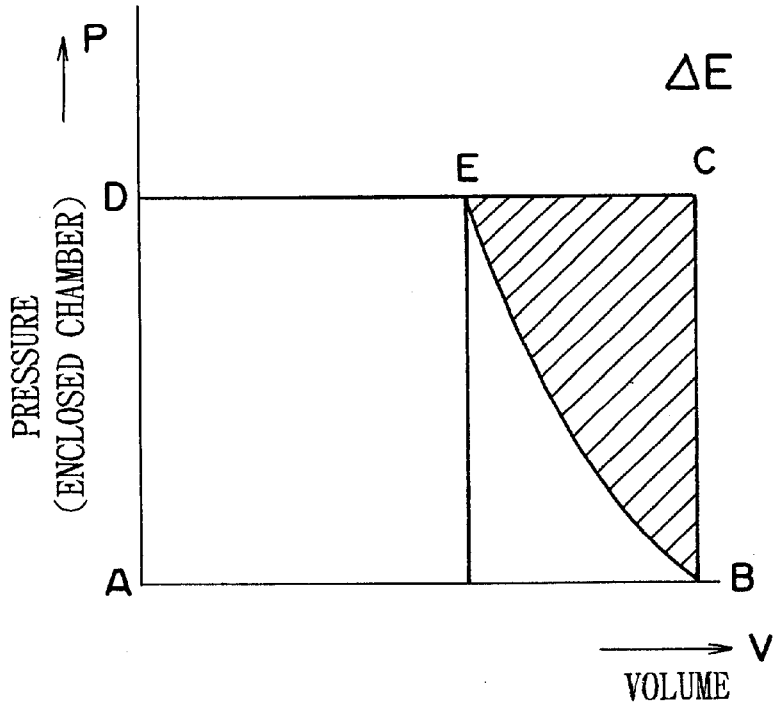
FIG. 7 is a graph showing a relationship between a pressure and a volume of a fluid which is under an adiabatic compression state.
Figure 8:
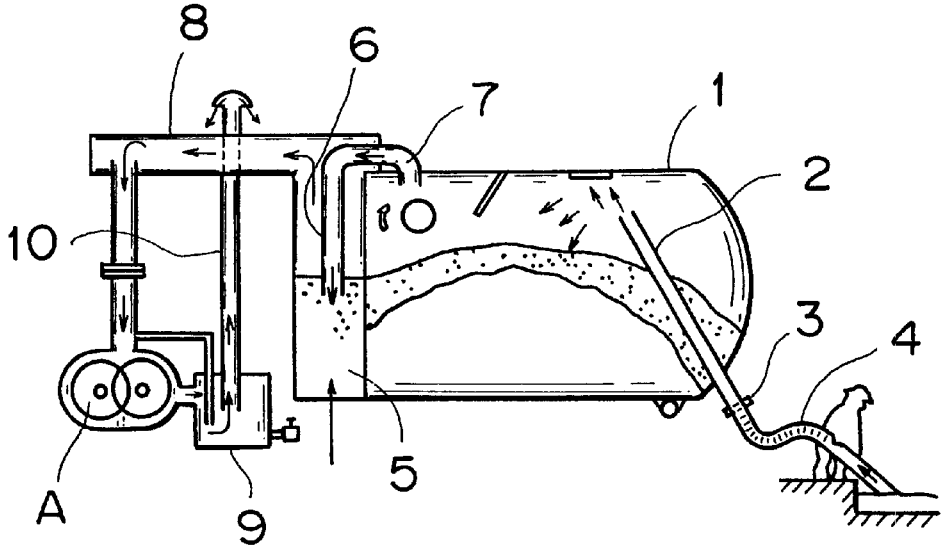
FIG. 8 is an illustration showing a sludge stripping unit in which a vacuum pump draws in a fluid including an entrained matter through a suction port of the vacuum pump.
Figure 9:
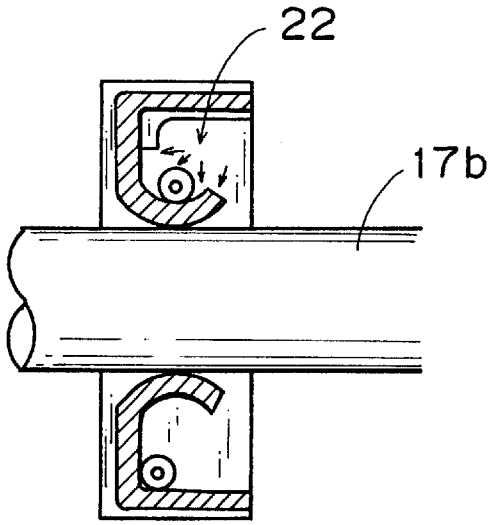
FIG. 9 is a longitudinal sectional view showing a sealing portion of the vacuum pump.
Figure 10:
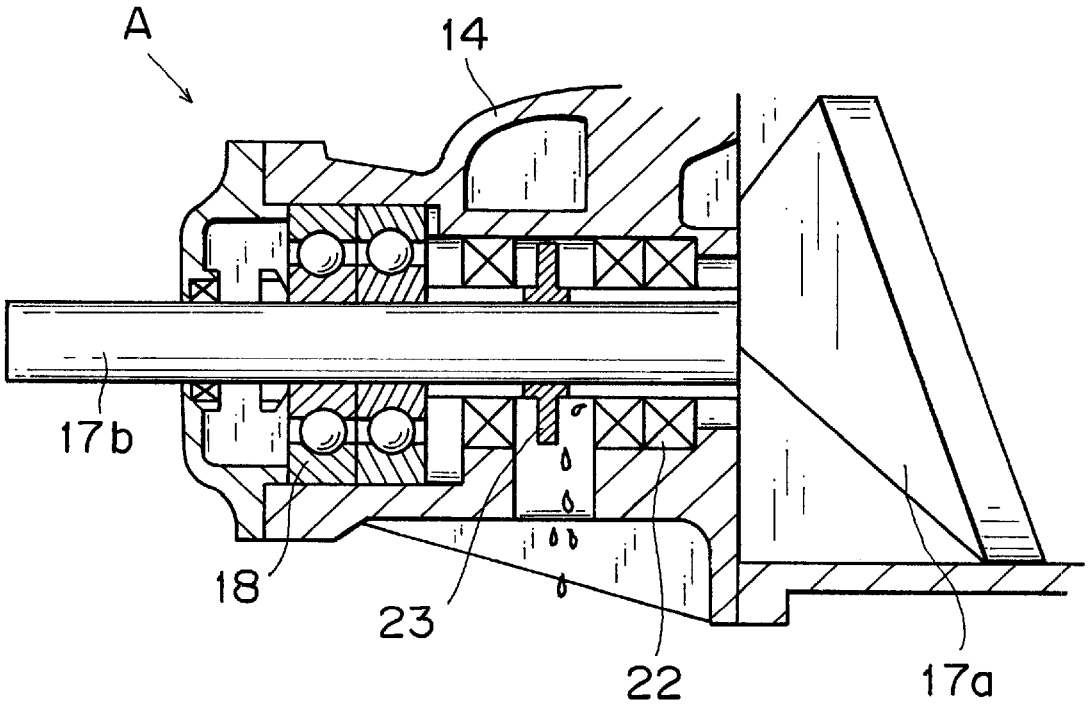
FIG. 10 is a longitudinal sectional view showing a slinger and its surroundings regarding the vacuum pump.

FIG. 1 is a general front view of a screw rotor type wet vacuum pump for explaining a first embodiment of the present invention; FIG. 2 is a front view showing a side housing with a discharge port 24 of the pump; FIG. 3 is an illustration showing a relationship between an enclosed chamber and the discharge port 24; FIG. 4 is a graph showing a relationship between a suction pressure and a pressure just before releasing regarding the pump; and FIG. 5 is a longitudinal sectional view showing an example of a valve included in a second embodiment of the present invention.

First, FIG. 3 is referred. FIG. 3 illustrates an inner cylinder 12*a* and an enclosed chamber 20 which are developed in a plane. The inner cylinder 12*a* has a suction port 15 at a right end portion thereof. A discharge port 24 provided in a side cap 14 is located at a central portion of a left end (line L) of the inner cylinder 12*a*.

The enclosed chamber 20 is defined between two sealing lines 17*c*, 17*d* and moves from a right side to a left side of FIG. 3 with the rotation of screw rotors 17.

The enclosed chamber 20 is communicating with the suction port 15 when the right side seal line 17*c* and the suction port 15 overlaps one another (which is shown with solid lines). In this state, a fluid in the enclosed chamber 20 has not been compressed. The enclosed chamber 20 is isolated from the suction port 15 when the right side seal line 17*c* moves leftward to be apart from the suction port 15.

With the leftward movement of the enclosed chamber 20, a fluid in the enclosed chamber 20 is compressed. When the left side seal line 17*d* and the discharge port 24 overlap one another, the fluid, which is compressed in a volume of about 1/1.6, is delivered into an outlet port 16 of the side cap 14 through the discharge port 24 (see FIG. 2).

FIG. 4 is a graph showing a relationship between fluid pressures of the suction port 15 and the discharge port 24 when the fluid is compressed under an adiabatic compression in a volume of about 1/1.6. A horizontal coordinate indicates a fluid pressure at the suction port 15, and a vertical coordinate indicates a fluid pressure at the discharge port 24.

In the graph, at a cross point of an inclined line with a vertical line showing a normal atmospheric pressure (760 Torr) , the fluid pressure is 1 kg/cm2 at the discharge side. A fluid which is 380 Torr (−380 mmHg) in pressure at the suction side becomes 0 (zero) kg/cm2 at the discharge side, while a fluid which is 60 Torr at the suction side becomes −640 Torr at the discharge side.

Thus, when the suction pressure is lower than 380 Torr (−380 mmHg), the fluid pressure of the enclosed chamber 20 is a negative pressure invariably. Thereby, a drawn-in sealing water is prevented from leaking at a compressing end of the enclosed chamber 20.

Further advantageously, it has been found that, when the suction pressure is higher than 380 Torr, the housing 11 dissipates heat and makes no contact with the screw rotors 17 without a sealing water.

Thus, the following two methods for drawing in a sealing water will be proposed when the suction pressure is about 380 Torr (or lower than 380 Torr).

(1) The housing 11 communicates with a sealing water supply line provided with a valve which opens by means of a spring when the suction pressure becomes lower than 380 Torr.

(2) A feed pipe 26 is connected to the housing 11 between the sealing lines 17*c*, 17D such that the feed pipe 26 communicates with the enclosed chamber 20. In this state, the enclosed chamber 20 has been moved to be isolated from the suction port 15 and is in a state just before communicating with the discharge port 24. Thereby, the sealing water is not drawn in when the enclosed chamber 20 is under a positive pressure. Meanwhile, the sealing water is drawn in when the enclosed chamber 20 is under a negative pressure. This performs the same function as the valve of the method (1).

A first embodiment of the present invention adopts the method (2), and a second embodiment adopts the method (1), which will be discussed hereinafter.

In the first embodiment, there is provided an inlet 25 communicating with the inner cylinder 12*a* of the housing 11. The inlet 25 is arranged to communicate with the enclosed chamber 20 when the enclosed chamber 20 is isolated from the suction port 15 and is in a state just before communicating with the discharge port 24. At that time, a fluid in the enclosed chamber 20 is compressed in a volume of about 1/1.6. The inlet 25 is connected to an end of a sealing water feeding feed pipe 26 which is opened in a sealing water supply tank 27 at the other end thereof (see FIG. 1).

Into the sealing water supply tank 27, a sealing water is supplied from a water feed pipe line 28 having a closing valve 29. The sealing water supply tank 27 has a side wall provided with an over-flow opening 30. Thus the sealing water in the sealing water supply tank 27 is not pressurized.

Because of these constitutions, no sealing water is fed into the pump when the fluid pressure of the enclosed chamber 20 is higher than the atmospheric pressure with being compressed in a volume of about 1/1.6. Meanwhile, a sealing water is fed into the pump only when the fluid pressure of the enclosed chamber 20 is lower than the atmospheric pressure. Hence, the sealing water doe snot leak to the out side from the shaft sealing portion 22 so that the shaft sealing portion 22 and the fixed bearing 18 are protected from a damage thereof.

In a second embodiment of the present invention, the housing 11 has a suction side through hole connected to a feed pipe (not shown). The feed pipe is provided with a valve V for passing a sealing water when the suction pressure of the pump is lower than about 380 Torr.

FIG. 5 is a longitudinal sectional view showing an example of the valve V. The valve V has a main body 31 in which there are provided a through hole consisting of a smaller diameter cylinder 32 and a larger diameter cylinder 33 coaxial with each other. The smaller diameter cylinder 32 is provided with a closing plate 34, and the larger diameter cylinder 33 is provided with a closing plate 35.

In the valve main body 31, there are provided, a communication port 36 communicating with the smaller diameter cylinder 32, a pair of connection ports 37, 38 opposed to each other and communicating with the larger diameter cylinder 33, and a pair of sealing water ports 39, 40 opposed to each other and communicating with the larger diameter cylinder 33. The closing plate 34 has a through hole 41.

The communication port 36 and the connection port 37 are connected to a T-shaped coupling 42. The coupling 42 is also connected to a pipe line (not shown) communicating with a suction side of the vacuum pump. The connection port 38 communicates with the through hole 41 through a conduit 43.

The sealing water port 39 is connected to a pipe line communicating with a sealing water supply tank (not shown). The sealing water port 40 is connected to a pipe line (not shown) communicating with the suction side of the vacuum pump.

The valve main body 31 receives a spool 44 therein. The spool 44 has a smaller diameter valve portion 45 inserted into the smaller diameter cylinder 32 and also has a pair of larger diameter valve portions 46, 47 inserted into the larger diameter cylinder 33. Between the smaller diameter valve portion 45 and the closing plate 34, a spring 48 is mounted.

In thus configured valve V, the spring 48 urges the spool 44 to move it to a right side of FIG. 5 so that the larger diameter valve portion 47 normally closes the sealing water ports 39, 40. When the suction pressure of the vacuum pump becomes lower than −380 mmHg, the suction pressure is transmitted to the smaller diameter cylinder 32 through the coupling 42. Thereby, the spool 44 moves to the left side against the spring 48 because the smaller diameter valve portion 45 and the larger diameter valve portion 46 are different in their pressure exerted areas.

The leftward movement of the spool 44 causes the larger diameter valve portion 46 to open the connection ports 37,38, so that the suction pressure of the vacuum pump is transmitted to the smaller diameter cylinder 32 trough the connection ports 37, 38 and the conduit 43. The spool 44 moves leftward until the spool 44 abuts against the closing plate 34, so that the larger diameter valve portion 47 opens the sealing water ports 39, 40 to allow the sealing water to flow into the suction port of the vacuum pump.

When the suction pressure of the vacuum pump becomes higher than −380 mmHg, the spool 44 moves rightward, so that the larger diameter valve portion 47 closes the sealing water ports 39, 40 to prevent the sealing water from flowing into the suction port of the vacuum pump.

That is, the feed of the sealing water is controlled by the suction pressure of −380 mnmHg.

INDUSTRIAL APPLICABILITY OF THE INVENTION

Thus configured present invention performs operational effects described in the following.

(1) When the suction pressure of the vacuum pump is higher than −380 mmHg, the feed of a sealing water is automatically stopped. No seizing of the screw rotors occurs without the feed of a sealing water.

(2) When the suction pressure of the vacuum pump is lower than −380 mmHg, a sealing water is automatically fed, preventing seizing of the screw rotors.

The present invention eliminates the problem described in the background of the invention that a sealing water with the compressed fluid in the enclosed chamber hits the seal portion to cause a damage thereof or that the bearing suffers a damage by a sealing water and the fluid which are leaked trough the seal portion when the suction pressure of the vacuum pump is lower than −380 mmHg.

What is claimed is:

1. A screw rotor type wet vacuum pump comprising a housing having an inner cylinder accommodating a pair of screw rotors engaging with each other, a suction port, and a discharge port, the screw rotors being of a Quimby type, each of the screw rotors having a screw profile having a circular arc and a quasi-Archimedean spiral curve, the discharge port being opened when the rotation of the screw rotor reduces the volume of an enclosed chamber at a compression rate of about 1/1.6, the enclosed chamber being defamed by the rotors and the housing to receive a fluid drawn in from the suction port, wherein a feed pipe for a sealing water is connected to the housing to communicate with the enclosed chamber which is at a position just before the enclosed chamber begins to open to the discharge port such that a negative pressure in the enclosed chamber can draw the sealing water into the enclosed chamber.

2. A screw rotor type wet vacuum pump comprising a housing having an inner cylinder accommodating a pair of screw rotors engaging with each other, a suction port, and a discharge port, the screw rotors being of a Quimby type, each of the rotors having a screw profile having a circular arc and a quasi-Archimedean spiral curve, the discharge port being opened when the rotation of the screw rotors reduces the volume of an enclosed chamber at a compression rate of about 1/1.6, the enclosed chamber being defamed by the rotors and the housing to receive a fluid drawn in from the suction port, wherein a feed pipe for a sealing water is connected to the suction port of the vacuum pump, and the feed pipe is provided with a valve having a spool and an inlet port, the spool receiving a pressure force through the inlet port communicating with the suction port of the housing such that the spool moves to open the valve when a fluid pressure of the suction port of the housing becomes lower than −380 mnmHg.

* * * * *